US007002519B2

(12) United States Patent
Wang et al.

(10) Patent No.: US 7,002,519 B2
(45) Date of Patent: Feb. 21, 2006

(54) ANTENNA

(75) Inventors: Hanyang Wang, Witney (GB); Su Quing Zhang, Oxford (GB)

(73) Assignee: Nokia Corporation, Espoo (FI)

( * ) Notice: Subject to any disclaimer, the term of this patent is extended or adjusted under 35 U.S.C. 154(b) by 49 days.

(21) Appl. No.: 10/462,693

(22) Filed: Jun. 17, 2003

(65) Prior Publication Data

US 2004/0070540 A1 Apr. 15, 2004

Related U.S. Application Data

(63) Continuation-in-part of application No. 10/020,197, filed on Dec. 18, 2001, now Pat. No. 6,621,455.

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 767, 770, 768

See application file for complete search history.

(56) References Cited

U.S. PATENT DOCUMENTS

| | | | | |
|---|---|---|---|---|
| 5,914,693 | A * | 6/1999 | Takei et al. | 343/767 |
| 6,342,857 | B1 | 1/2002 | Lane | |
| 2002/0135521 | A1 | 9/2002 | Moore | |
| 2002/0175861 | A1 | 11/2002 | Lin | |

FOREIGN PATENT DOCUMENTS

| | | | |
|---|---|---|---|
| EP | 1 304 765 | * | 4/2003 |
| EP | 1 304 765 A2 | | 4/2003 |
| WO | WO 01/08257 A1 | | 2/2001 |

OTHER PUBLICATIONS

Salonen et al., "New slot configurations for dual-Band Planar Inverted-F Antenna" Microwave and Optical Technology Letters, vol. 28, No. 5, Jan. 23, 2001, pp. 293-298.*
Salonen, P., et al: "New Slot Configurations for Dual-Band Planar Inverted-F Antenna", appearing in Microwave and Optical Technology Letters, John Wiley, New York, NY, US, vol. 28, No. 5, Jan. 23, 2001, pp. 293-298, XP002245702, ISSN: 0895-2477.

(Continued)

*Primary Examiner*—Thuy V. Tran
*Assistant Examiner*—Hung Tran Vy
(74) *Attorney, Agent, or Firm*—Alston & Bird LLP

(57) ABSTRACT

A method of independently modifying the ¼ and/or the ¾ wavelength resonant frequency in an open-ended slotted PIFA antenna, an open-ended slotted PIFA antenna comprising an antenna feed and an antenna ground wherein the antenna ground is associated with the antenna short-circuit end, and an open-ended slot having an open-end associated with the antenna open-circuit end, and wherein the antenna ground and the slot are mutually arranged to provide operational variations in the current density between the open and short circuit ends of the antenna and around the perimeter of the slot, and an operational mean current path length between the open and short circuit ends of the antenna and around the perimeter of the open-ended slot, the mean current path length determining the ¼ and ¾ wavelength resonant frequencies for the open-ended slotted PIFA antenna, the method comprising determining operational variations in current density around the perimeter of a pre-modified open-ended slotted PIFA antenna and modifying the mean current path length around the perimeter of the pre-modified open-ended slot in regions of comparatively high current density.

21 Claims, 18 Drawing Sheets

OTHER PUBLICATIONS

Fu-Ren Hsiao et al: "A dual-Band Planar Inverted-F Patch Antenna with a Branch-Line Slit", appearing in Microwave and Optical Technology Letters, John Wiley, New York, NY, US, vol. 32, No. 4, Feb. 20, 2002, pp. 310-312, XP002246573, ISSN: 0895-2477.

Jung-Hyo Kim et al: "Frequency Tuning of Slot-Loaded Rectangular Patch Antenna With Tuning Stubs and Gaps", appearing in IEEE Antennas and Propagation Society International Symposium, 2001 Digest. APS. Boston, MA, Jul. 8-13, 2001, New York, NY: IEEE US vol., vol. 1 of 4, Jul. 8, 2001, pp. 298-301, XP010564287, ISBN: 0-7803-7070-8.

Pekka Salonen, Mikko Keskilammi and Markku Kivikoski; *New Slot Configurations for Dual-Band Planar Inverted-F Antenna*; Microwave and Optical Technology Letters; Mar. 5, 2001; pp.293-298; vol. 28, No. 5.

* cited by examiner

BACKGROUND ART

BACKGROUND ART

BACKGROUND ART

ANTENNA

CROSS REFERENCE TO RELATED APPLICATION

This application is a continuing application of Ser. No. 10/020,197, entitled Multiband Antenna filed on Dec. 18, 2000, now U.S. Pat. No. 6,621,455 which application is incorporated hereby by reference in its entirety.

FIELD OF THE INVENTION

The present invention relates to open-ended slotted PIFA antennas having a ¼ wavelength resonance mode at a first frequency and a ¾ wavelength resonance mode at a second frequency and a method of adjusting the frequency ratio between the ¼ and ¾ wavelength resonant frequencies while maintaining independent control of the ¼ wavelength and ¾ wavelength resonant frequencies. The method can be used in the design/manufacture of open-ended slotted PIFA antennas with ¼ and ¾ wavelength resonance modes which can have resonance frequencies which vary from the normal 1:3 ratio. The present invention also relates to multi-band antennas.

BACKGROUND TO THE INVENTION

In recent years there has been a move towards harmonising mobile phone systems throughout the world. For instance, many countries have GSM900 systems enabling users from one country to use their mobile phones in another country. However, this harmonisation has not yet been completed. For instance, spectrum availability has let to the introduction of DCS1800 which is similar to GSM900 but operates in a band in the region of 1800 MHz rather than 900 MHz as in the case of GSM. Additionally, national spectrum management authorities do not necessarily decide to allocate the same bands to the public land mobile network service. For instance, in the United States of America a DCS1800-like system (PCS1900) is implemented in a band in the region of 1900 MHz. Further incompatibilities arise during transitional periods when a new system is being introduced and an old one phased out.

Accordingly, there is a need to provide a mobile phone antenna which can operate at various frequencies.

SUMMARY OF THE INVENTION

The invention provides methods and antennas according to the claims, and also as described with reference to specific embodiments.

BRIEF DESCRIPTION OF THE DRAWINGS

Embodiments of the present invention will now be described, by way of example, with reference to the accompanying drawings in which.

DETAILED DESCRIPTION OF THE PREFERRED EMBODIMENT

Figure 1:
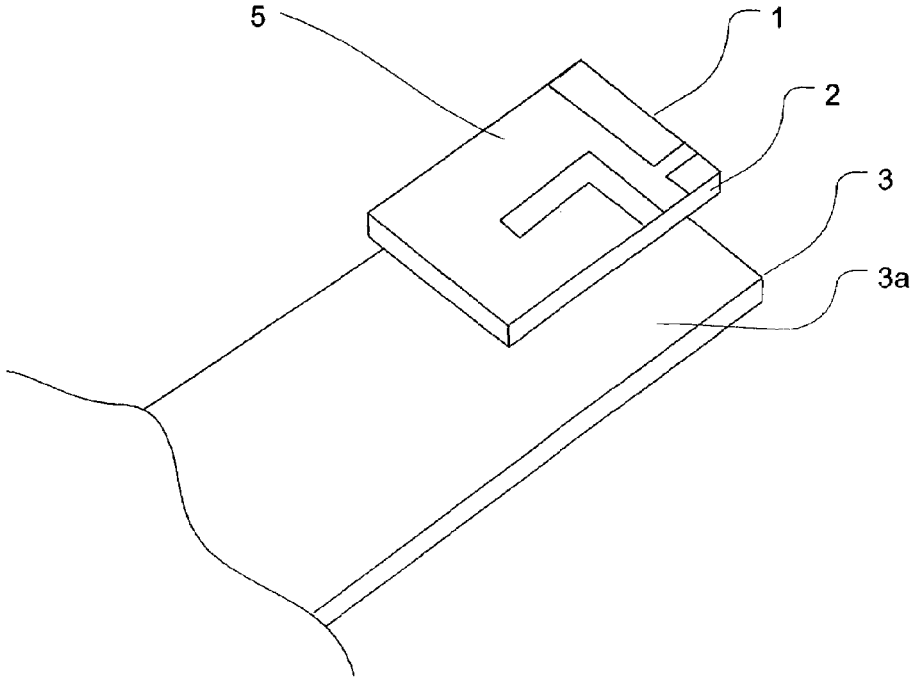
Figure 1 BACKGROUND ART
FIG. 1 is a prior art perspective view of what is known in the art as a slotted PIFA antenna with an indirect feed (not shown)

A prior art drawing of what is known in the art as a quarter wavelength resonant slotted PIFA antenna 1 is illustrated in FIG. 1 disposed on a substrate 2 mounted (mounting not shown) to the main Printed Circuit Board (PCB) 3 of a radio communication device. The antenna/substrate ½ are generally rectangular in shape and lie above and parallel to a major face 3*a* of the larger rectangular main printed circuit board 3. Such an antenna is configured to resonate at a ¼ wavelength resonant frequency (e.g. 980 MHz) and a ¾ wavelength resonant frequency (e.g. 2.8 GHz) by virtue of its geometry (overall size/shape, slot size/shape/position). It will be appreciated that the frequencies quoted against specific antenna geometries throughout the text are provided for guidance purposes and do not necessarily reflect actual frequencies for specific geometries.

The antenna 1, which is disposed on the away facing (with respect to the underlying PCB 3) surface 5 of the substrate 2, is formed from copper (a conductive material). Furthermore, the antenna 1 comprises an inverted L-shaped slot 4 which is defined by the absence of copper from a L-shaped region (4*a*, 4*b*) of the conductive layer 5. The slot 4 comprises a first section 4*a* which extends perpendicularly from approximately a third of the way down the right hand side of the substrate 2 and extends to approximately midway across the surface 5 to a first distal end 6. The slot 4 has a second section 4*b* extending at a right angle from the first distal end 6 towards the lowermost edge of the surface 5 to a second distal end 13 (FIGS. 1–2).

Figure 2:
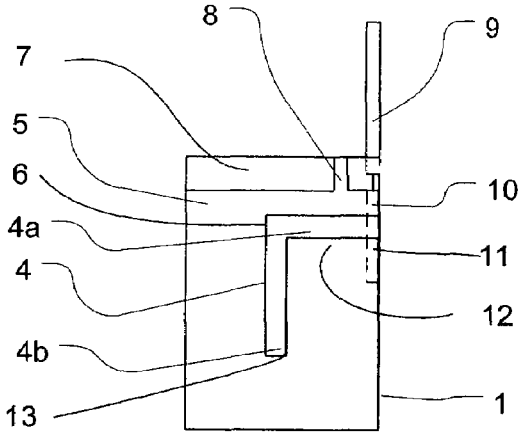
FIG. 2 is a plan view of FIG. 1, illustrating the indirect feed.

The copper conductor is also absent from a margin 7 along the upper edge of the surface 5, save for a branch 8 situated towards the right hand side of the surface 5 and extending to the upper edge of the substrate 2 (FIGS. 1–2). The branch 8 is electrically grounded so as to define a fixed electrical short circuit (minimum E field position).

The antenna's feed 9, 10 is provided on the underside (with respect to surface 5) of the substrate 2, this underside facing the major face 3*a* of the PCB 3. The feed comprises a coaxial cable 9 and a conductive strip 10 (indicated with dashed lines in FIG. 2) aligned with the right hand edge of the substrate 2. The feed 9, 10 does not form a conductive path to the surface 5 and will be recognised by those skilled in the art as an indirect feed arrangement. The conductive strip 10 starts at the edge of the aforementioned margin 7 and extends until it coincides with the electrically open circuit of the slotted PIFA antenna 1, which in FIG. 2, is approximately midway down the right hand edge of the substrate 2. This position is also known as the maximum E field position 11.

Figure 3:
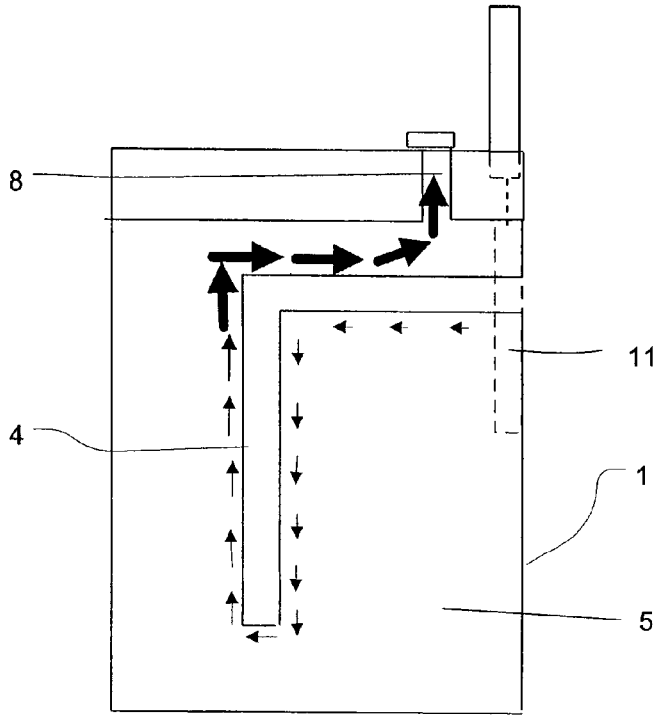
Figure 3 BACKGROUND ART
FIG. 3 is a schematic representation of the current flow around the prior art antenna of FIG. 2 at the ¼ wavelength resonant frequency.

The surface 5 of the antenna 1 acts as a ¼ wavelength resonant element at a first frequency (FIG. 3, 4). This antenna 1 is also resonant at a second frequency which will be approximately three times the first frequency (FIG. 5, 6) i.e. also acts as a ¾ wavelength resonant element. It should be noted that what is known in the art as a ¼ wavelength resonant PIFA antenna would be resonant at frequencies which are odd integer multiples of a quarter wavelength, e.g. ¼, ¾ etc. The antenna 1 may have resonant frequencies which are not exact integer multiples of a quarter wavelength due to antenna coupling effects, which can occur when the distal end 12 of the conductive layer 5 is in close proximity to the branch 8. However, such coupling effects apply to all the resonant frequencies at the same time (to varying degrees).

The current density around the prior art antenna 1 will now be described by way of example at the ¼ and ¾ wavelength resonant frequencies. For clarity and simplicity, the current densities will be treated separately but it will be appreciated by those skilled in the art that the current densities, as shown in FIGS. 3 and 5 of the antenna 1 can occur simultaneously when the antenna 1 is excited by both the ¼ and ¾ wavelength resonant frequencies.

Figure 4:
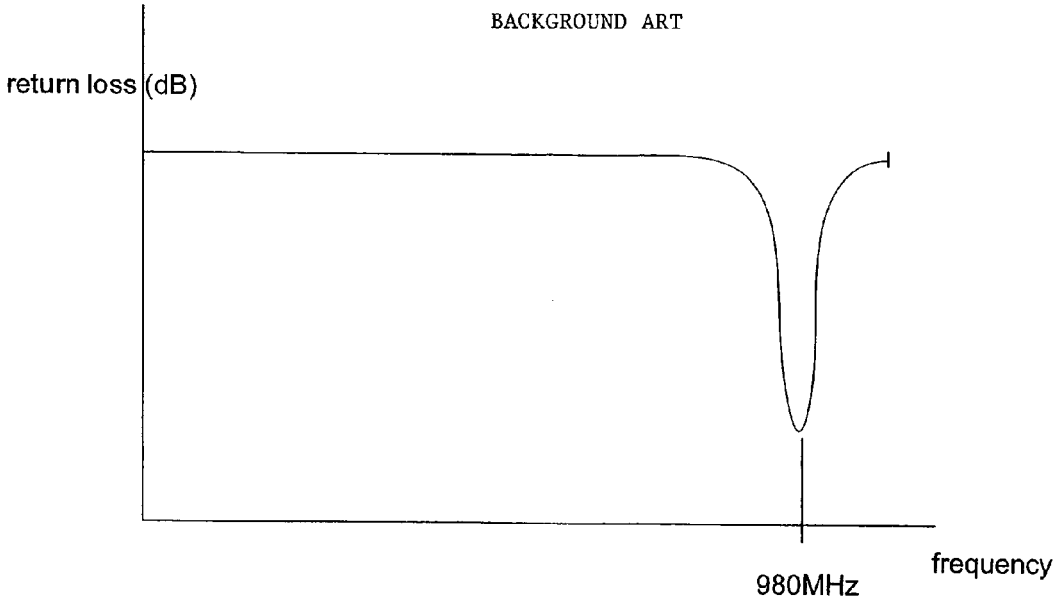
FIG. 4 is a return loss v frequency plot illustrating the ¼ wavelength resonant frequency of the prior art antenna of FIG. 2.

The antenna 1 of FIG. 2 is illustrated with the electrical current flow around the structure at the ¼ wavelength resonant frequency in FIG. 3. The electrical current flow is substantially located around the perimeter of the slot 4, flowing in a clockwise direction from the maximum E field position 11 of the antenna 1 to the short circuit end of the antenna, which coincides with the branch 8 (minimum E field position). The maximum electrical current density occurs at the short circuit end of the antenna 1 at the branch 8 (minimum E field position), which is electrically grounded. The minimum electrical current density occurs at the open circuit end of the antenna 1 which coincides with the maximum E field position 11 which is approximately midway down the right hand side of the substrate 2. There is only one occurrence each of the maximum and minimum electrical current densities. The mean path length taken by the current around the slot 4 determines the ¼ wavelength of the antenna. The resultant ¼ wavelength resonant frequency in this case is 980 MHz and is illustrated in FIG. 4.

Figure 5:
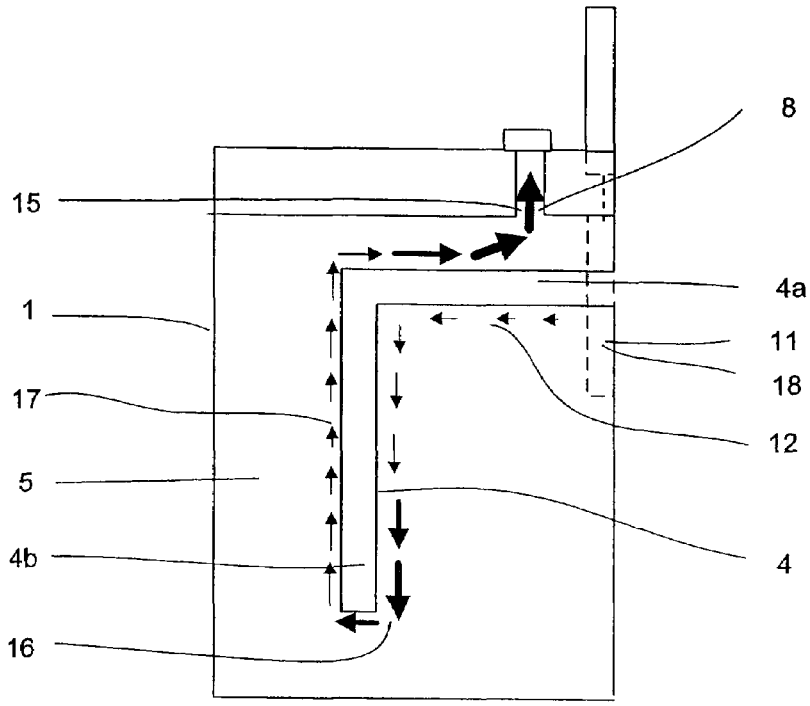
Figure 5 BACKGROUND ART
FIG. 5 is a schematic representation of the current flow around the prior art antenna of FIG. 2 at the ¾ wavelength resonant frequency.

The antenna 1 of FIG. 2 is illustrated with the electrical current flow around the structure at the ¾ wavelength resonant frequency in FIG. 5. Again, the electrical current flow is substantially located around the perimeter of the slot 4, flowing in a clockwise direction from the maximum E field position 11 of the antenna 1 to the short circuit end of the antenna 1, which coincides with the branch 8 (minimum E field position). However, in this case, there are two occurrences each of the maximum and minimum electrical current density. A first maxima 15 of the electrical current density occurs at the short circuit end of the antenna 1 which coincides with the branch 8, which is electrically grounded. A second maxima 16 occurs at a position which is electrically ½ wavelength away in a counter-clockwise direction around the slot 4 from the first maxima 15, coinciding with a position which is towards the lowermost edge of the section 4*b*. The first minima 17 of the electrical current density occurs at a position which is electrically a ¼ wavelength away in a counter-clockwise direction around the slot 4 from the first maxima 15 and coincides with a position which is approximately mid-way down the left hand edge of the section 4*b*. The second minima 18 of the electrical current density occurs at the open circuit end of the antenna which coincides with a position approximately mid-way down the right hand side of the substrate 2 and coincides with the maximum E field position 11. The mean path length taken by the current around the slot 4 determines the ¾ wavelength of the antenna.

Figure 6:
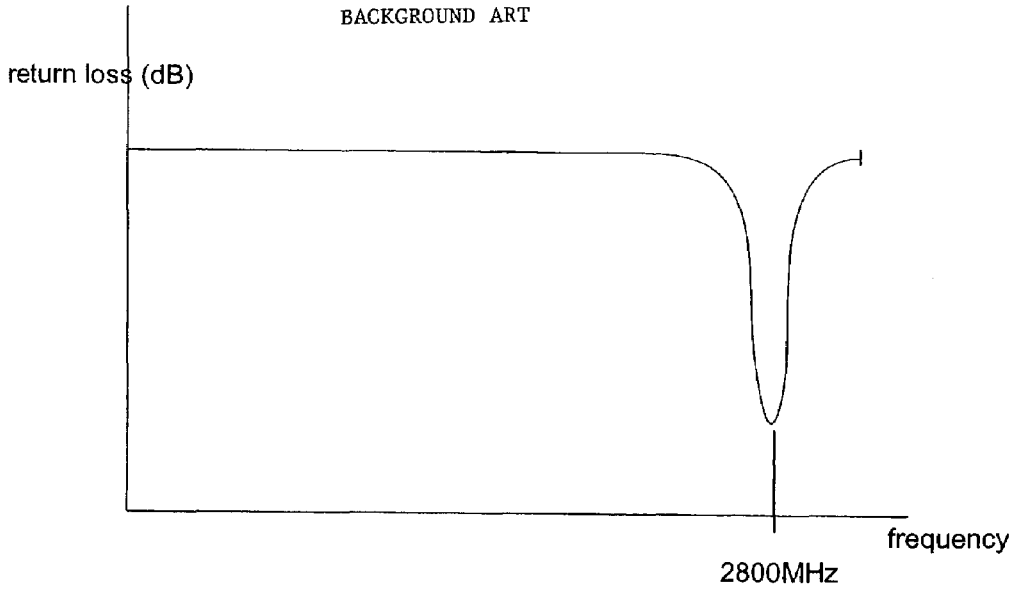
FIG. 6 is a return loss v frequency plot illustrating the ¾ wavelength resonant frequency of the prior art antenna of FIG. 2.

The resultant ¾ wavelength resonant frequency is shown at 2800 MHz in FIG. 6. As mentioned earlier, and as in this case, the ¼ and ¾ wavelength resonant frequencies of the prior art slotted PIFA antenna 1 (980 MHz and 2800 MHz) do not have a numerical ratio of exactly 1:3. As indicated already this is due to coupling effects between the distal end 12 of the surface 5 being in close proximity to the branch 8.

Figure 7:
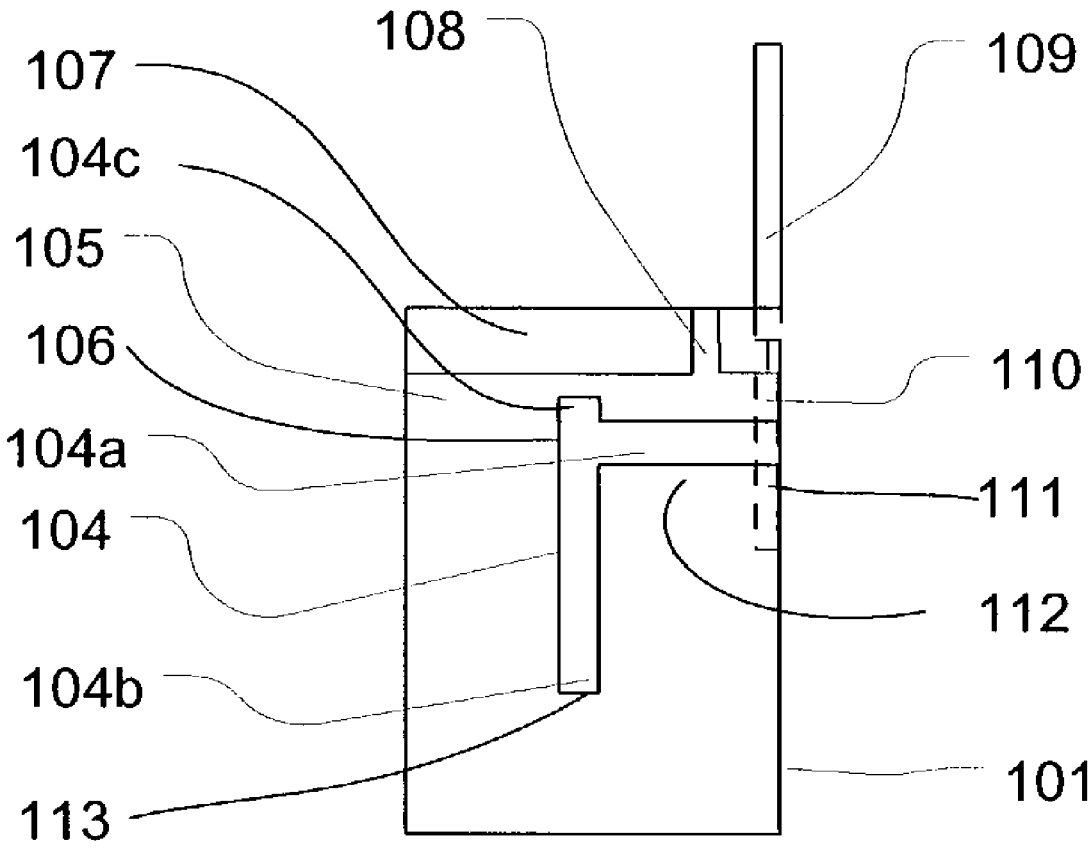
FIG. 7 is a drawing of a first embodiment of an antenna according to the present invention.
Figure 12:
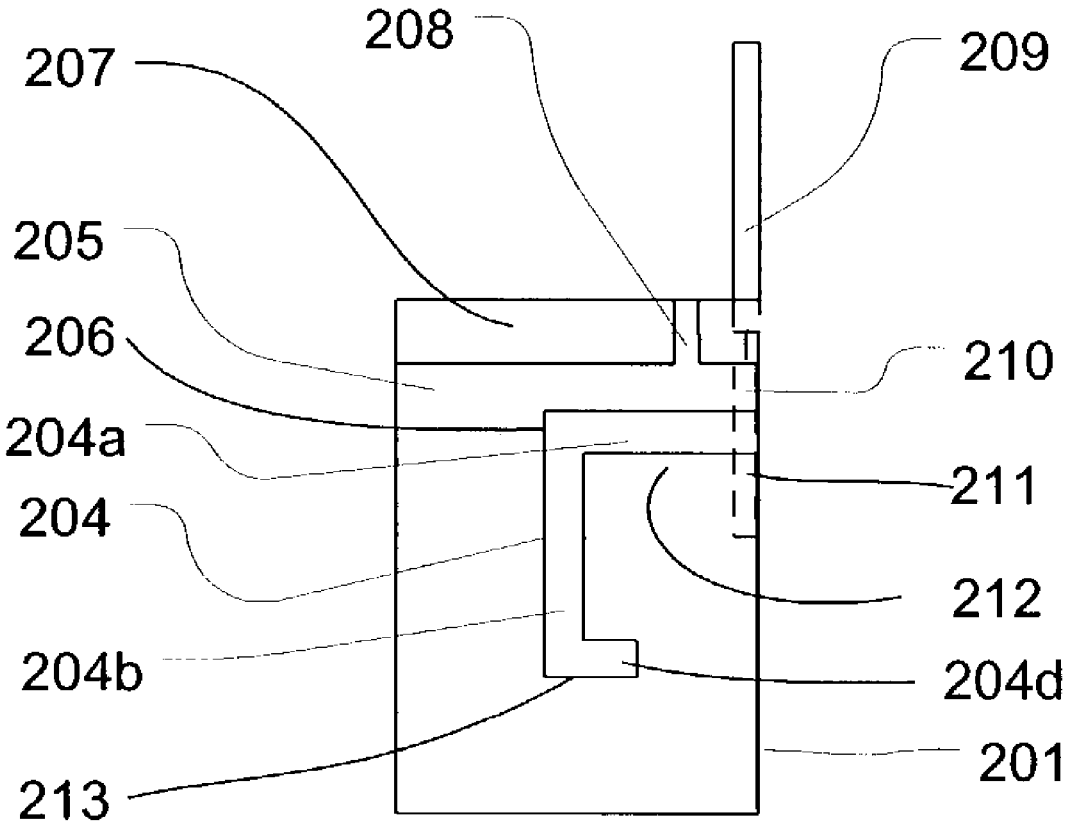
FIG. 12 is a drawing of a second embodiment of an antenna according to the present invention.
Figure 17:
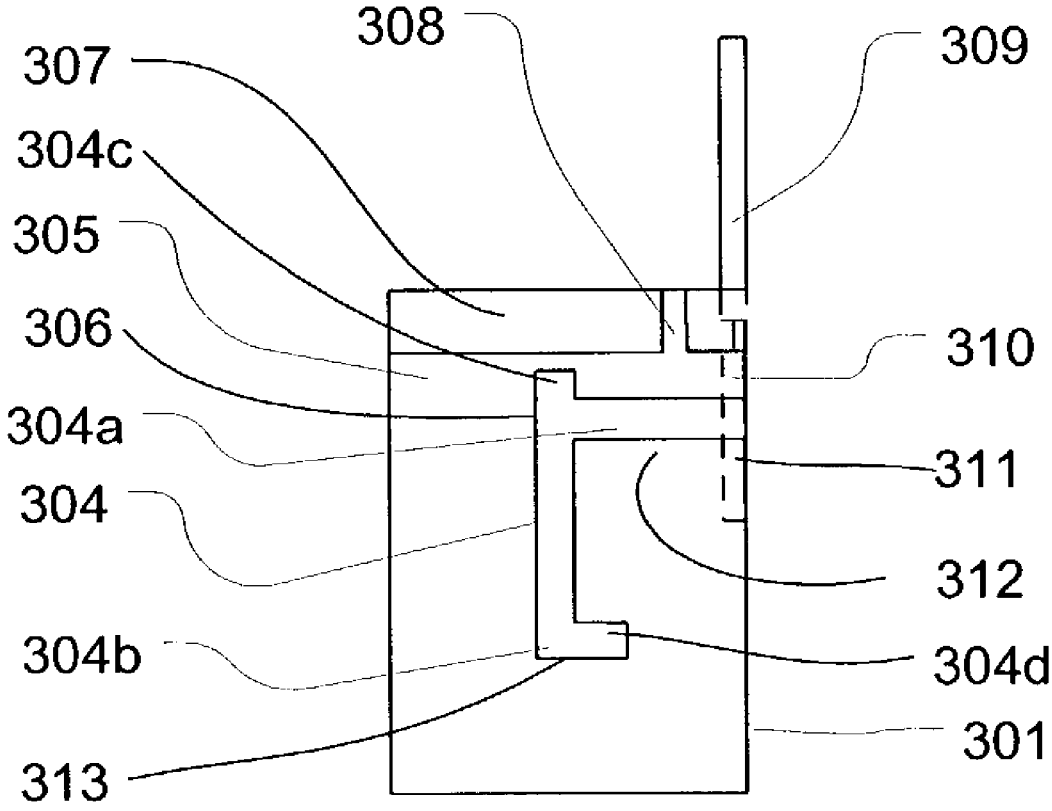
FIG. 17 is a drawing of a third embodiment of an antenna according to the present invention.

An antenna according to the present invention will now be described by making modifications to the antenna 1 of FIG. 2 by altering the current path length around the slot 4 to realise three embodiments of the present invention (FIGS. 7, 12 and 17). In each case, the mean current path length, with respect to the prior art of FIG. 2, has been changed by altering the perimeter/shape of the slot 4. The figure references 1–13 of FIGS. 1 and 2 have corresponding reference numbers 101, 201, 301 to 113, 213, 313 within FIGS. 7, 12 and 17 respectively.

The antenna 101 shown in FIG. 7 is the same as the antenna 1 of FIGS. 1 and 2 except that the inverted-L shape slot 4 of antenna 1 has a third section 104*c* to form a substantially r-shaped slot. The third section 104*c* extends at a right angle towards the uppermost edge of the substrate 102 from the distal end 106 of the first section 104*a*, orientated about the same vertical axis as the second section 104*b*.

Figure 8:
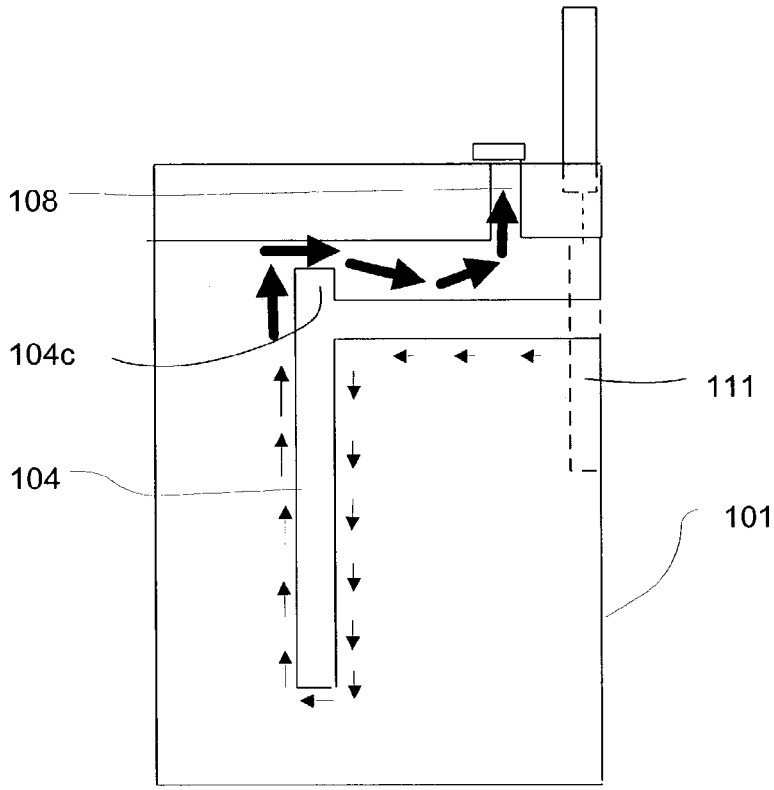
FIG. 8 is a schematic representation of the current flow around the antenna of FIG. 7 at the ¼ wavelength resonant frequency.
Figure 9:
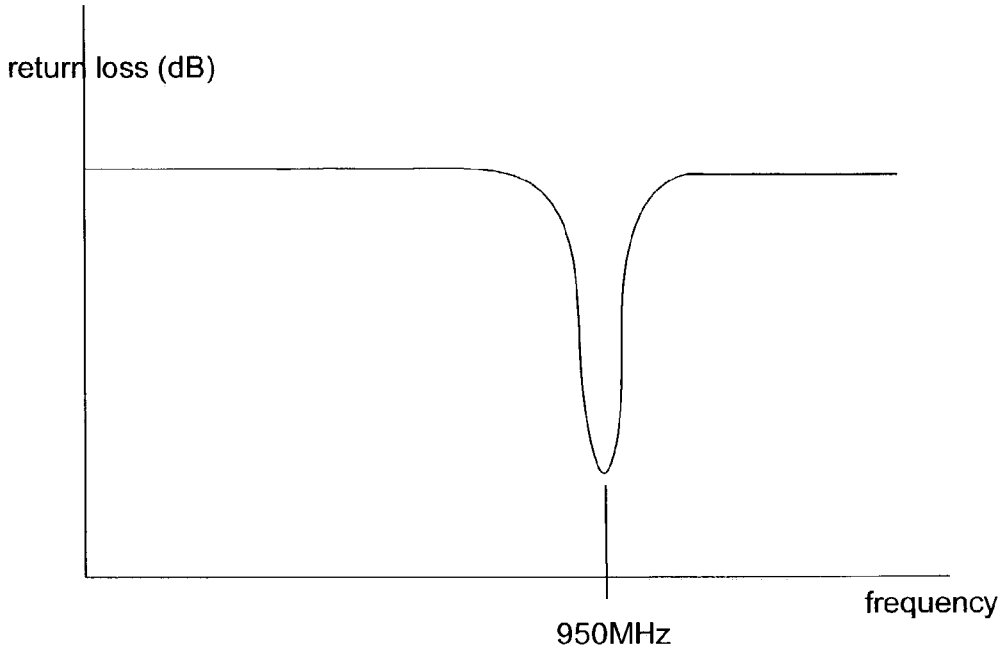
FIG. 9 is a return loss v frequency plot illustrating the ¼ wavelength resonant frequency of the antenna of FIG. 7.

The electrical current flow around the structure of the antenna 101 of FIG. 7 is illustrated in FIG. 8 at the ¼ wavelength resonant frequency. It is similar to FIG. 3, with corresponding features appropriately labelled. The mean path length taken by the current around the slot 104 determines the ¼ wavelength of the antenna and this arrangement provides a ¼ wavelength resonant frequency at 950 MHz (FIG. 9). Comparing FIGS. 3 and 8, it can be seen that the antenna 1 has been modified by the addition of the third section 104*c* to the slot 4. This modification has resulted in a change in the mean current path length in an area where the current density is large (c.f. the position of the maximum current density in FIG. 3 and 8 is largely unchanged given the small change in the perimeter of the slot 4). Changing the perimeter of the slot 4 where the current density is large and thereby changing the mean current path length where the current density is large changes the ¼ wavelength resonant frequency of the antenna 1. By increasing the current path length we have changed the resonant frequency from 980 MHz to 950 MHz.

Correspondingly, it will also be appreciated that a reduction in the slot perimeter where the current density is large and therefore a reduction in the mean current path length where the current density is large would result in the ¼ wavelength resonant frequency increasing.

Figure 10:
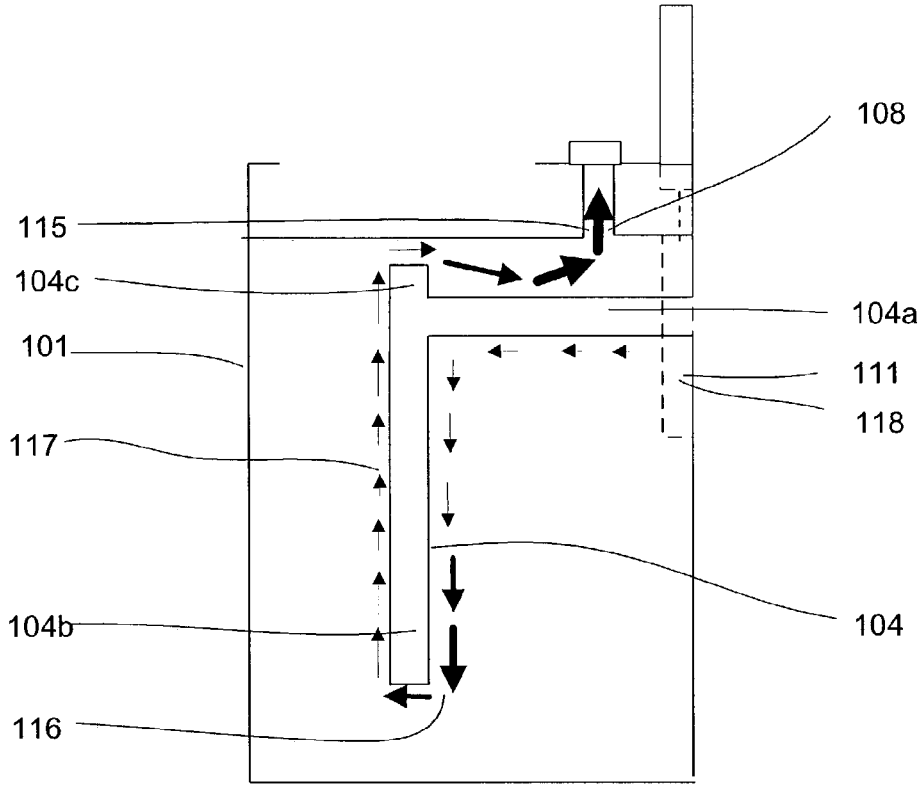
FIG. 10 is a schematic representation of the current flow around the antenna of FIG. 7 at the ¾ wavelength resonant frequency.
Figure 11:
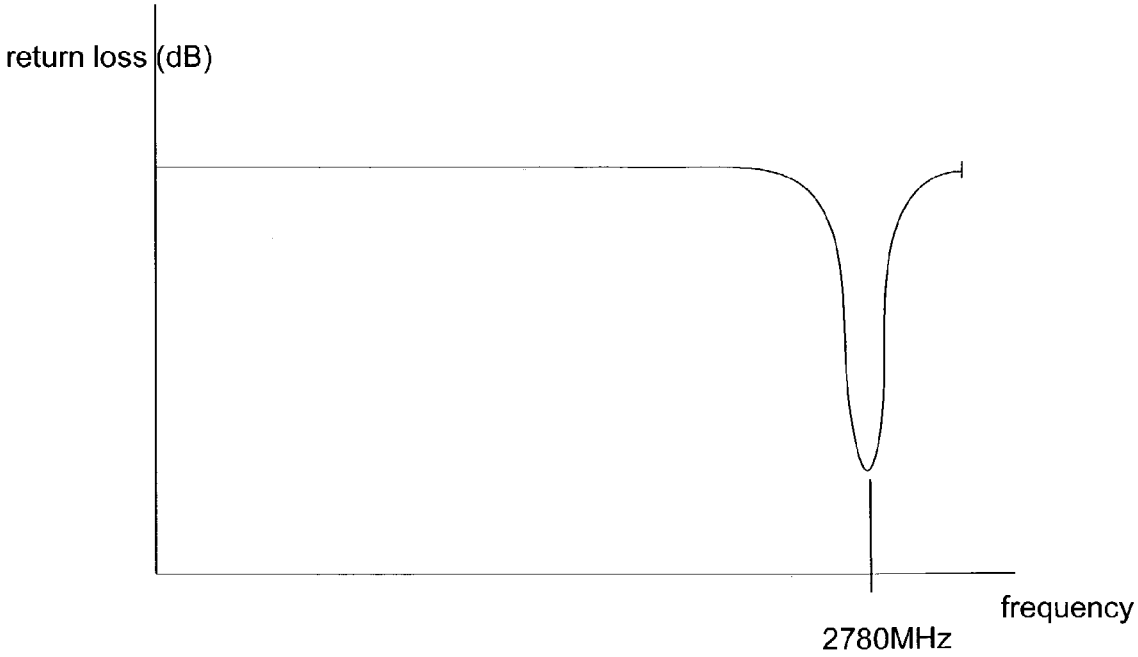
FIG. 11 is a return loss v frequency plot illustrating the ¾ wavelength resonant frequency of the antenna of FIG. 7.

The antenna 101 of FIG. 7 is illustrated with the electrical current flow around the structure at the ¾ wavelength resonant frequency in FIG. 10. It is similar to FIG. 5, with corresponding features appropriately labelled. The mean path length taken by the current around the slot 104 determines the ¾ wavelength of the antenna. The resultant ¾ wavelength resonant frequency is 2780 MHz and is shown in FIG. 11. Comparing FIGS. 5 and 10, it can be seen that the antenna 1 has been modified by the addition of the third section 104*c* to the slot 4. This modification has resulted in a change in the mean current path length in an area where the current density is small (c.f. the position of the minimum current density in FIG. 6 and 11 is largely unchanged). Comparing FIGS. 6 and 11, it can be seen that changing the perimeter of the slot 4 where the current density is small and thereby changing the mean current path length where the current density is small has a modest change on the ¾ wavelength resonant frequency of the antenna 101. By increasing the current path length we have changed the resonant frequency from 2800 MHz to 2780 MHz. Correspondingly, it will also be appreciated that a reduction in the slot perimeter where the current density is small and therefore a reduction in the mean current path length where the current density is small would result in the ¾ wavelength resonant frequency increasing.

In summary, the addition of the slot 104*c* to the antenna 1 substantially changes the ¼ wavelength resonant frequency of the antenna 101 and has a minimal effect on the ¾ wavelength resonant frequency.

Figure 13:
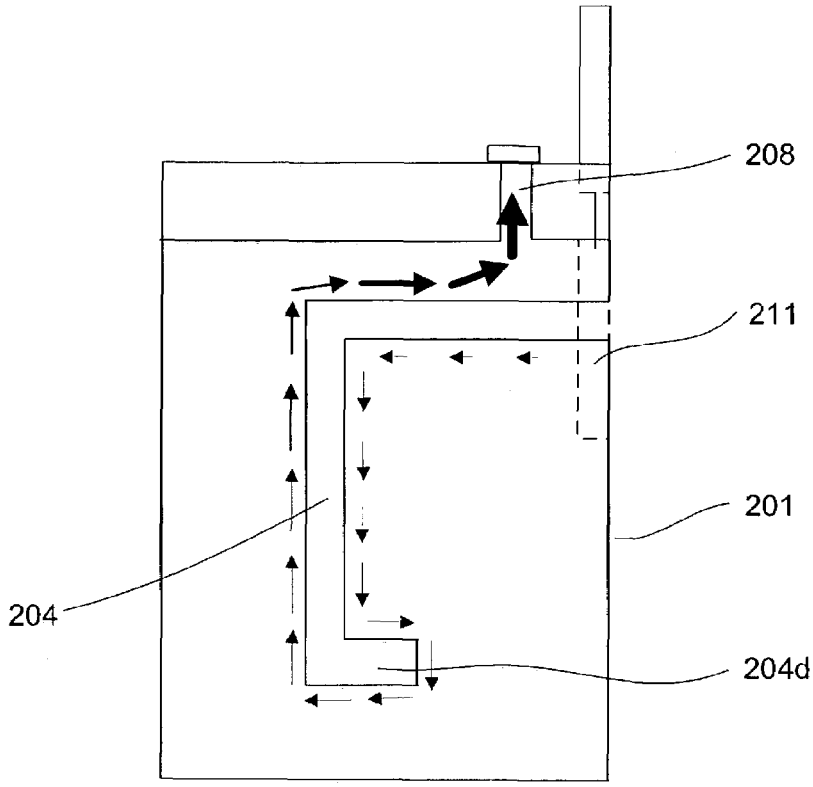
FIG. 13 is a schematic representation of the current flow around the antenna of FIG. 12 at the ¼ wavelength resonant frequency.
Figure 14:
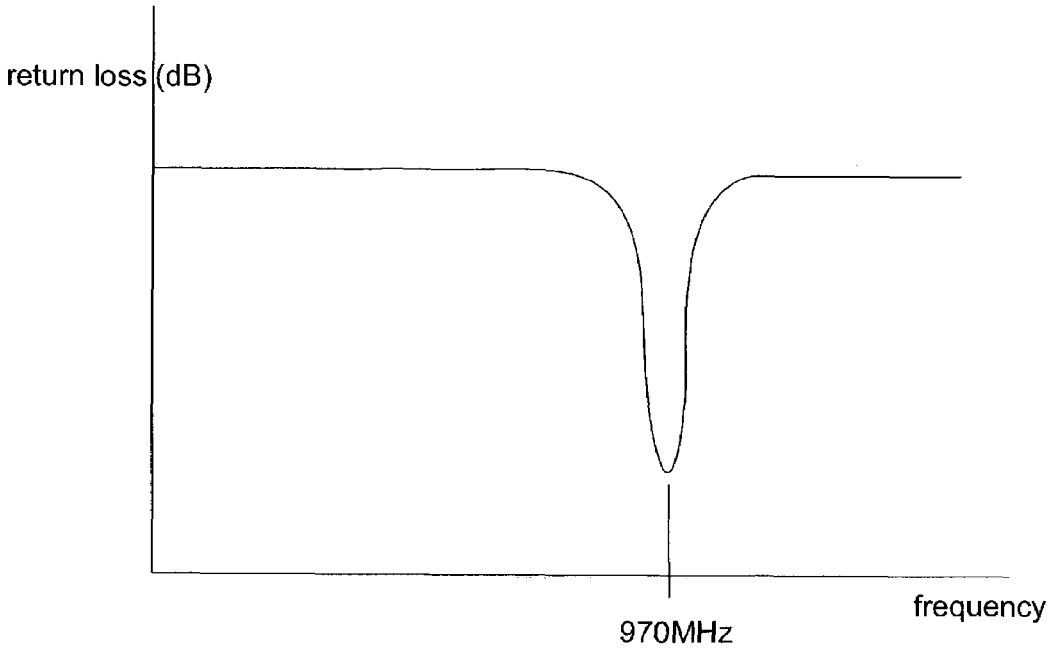
FIG. 14 is a return loss v frequency plot illustrating the ¼ wavelength resonant frequency of the antenna of FIG. 12.

A second embodiment is shown in FIG. 12 in which the antenna 201 is the same as the antenna 1 of FIGS. 1 and 2 except that the inverted-L shape slot 4 of antenna 1 has an additional section 204*d* to form a substantially C-shaped slot. The additional section 204*d* has been added at a right angle to the distal end 213 of the section 204*b* and extends in a direction towards the right hand edge of the substrate 202. FIG. 13 illustrates with the electrical current flow around the structure at the ¼ wavelength resonant frequency. The current flow is similar to FIG. 3, with corresponding features appropriately labelled. The mean path length taken by the current around the slot 204 determines the ¼ wavelength of the antenna, and is 970 MHZ in this case (FIG. 14).

Comparing FIGS. 3 and 13, it can be seen that the antenna 1 has been modified by the addition of the section 204*d* to the slot 4. This modification has resulted in a change in the mean current path length in an area where the current density is low. Comparing FIGS. 4 and 14 it can be seen that changing the perimeter of the slot 204 where the current density is low and thereby changing the mean current path length where the current density is low will change the ¼ wavelength resonant frequency of the antenna 1. By increasing the current path length we have changed the resonant frequency from 980 MHz to 970 MHz. Correspondingly, it will also be appreciated that a reduction in the slot perimeter where the current density is low and therefore a reduction in the mean current path length where the current density is low would result in the ¼ wavelength resonant frequency increasing.

Figure 15:
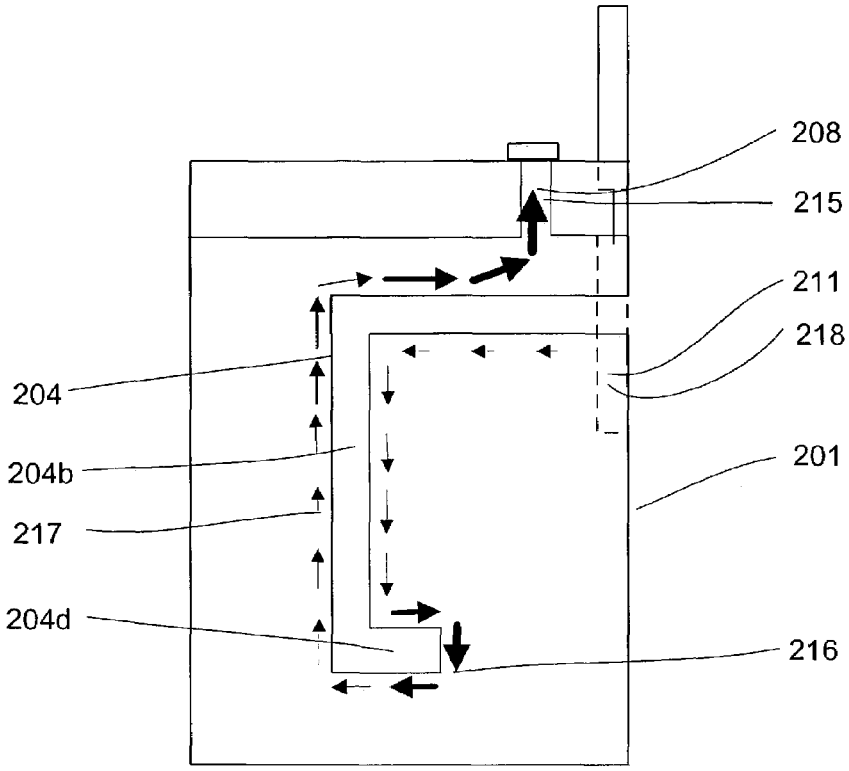
FIG. 15 is a schematic representation of the current flow around the antenna of FIG. 12 at the ¼ wavelength resonant frequency.
Figure 16:
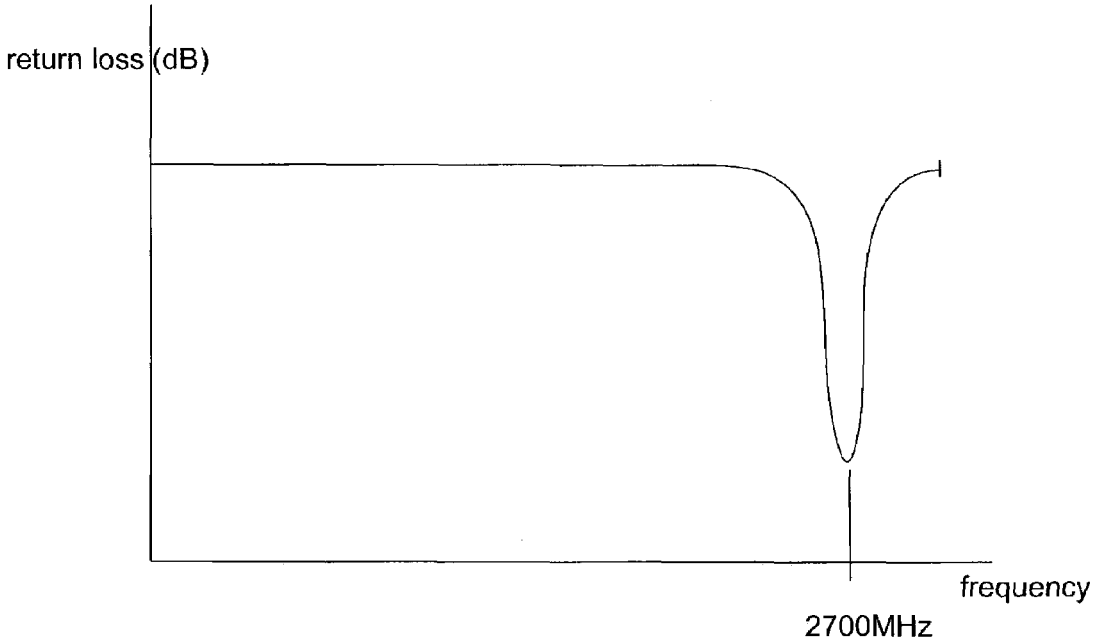
FIG. 16 is a return loss v frequency plot illustrating the ¾ wavelength resonant frequency of the antenna of FIG. 12.

The antenna 201 of FIG. 12 is illustrated with the electrical current flow around the structure at the ¾ wavelength resonant frequency in FIG. 15 It is similar to FIG. 5, with corresponding features appropriately labelled. The mean path length taken by the current around the slot 204 determines the ¾ wavelength of the antenna, and in this case is 2700 MHz (FIG. 16).

Comparing FIGS. 5 and 15, it can be seen that the antenna 1 has been modified by the addition of the section 204*d* to the slot 4. This modification has resulted in a change in the mean current path length in an area where the current density is large. Referring to FIGS. 6 and 16 it can be seen that changing the perimeter of the slot 204 where the current density is large and thereby changing the mean current path length where the current density is large will change the ¾ wavelength resonant frequency of the antenna 201. By increasing the current path length we have changed the resonant frequency from 2800 MHz to 2700 MHz. It will also be appreciated that a reduction in the slot perimeter where the current density is large and therefore a reduction in the mean current path length where the current density is large would result in the ¾ wavelength resonant frequency increasing.

In summary and with reference to FIGS. 3 to 16 it will be appreciated that the addition of the slot 204*d* to the antenna 1 substantially changes the ¾ wavelength resonant frequency of the antenna 201 and has a minimal effect on the ¼ wavelength resonant frequency.

A third embodiment is shown in FIG. 17, in which the antenna 301 is the same as the antenna 1 of FIGS. 1 and 2 except that the inverted-L shape slot 4 of antenna 1 has an additional third section 304*c* and fourth section 304*d* to form a substantially t-shaped slot 304. The third section 304*c* extends at a right angle towards the uppermost edge of the substrate 302 from the distal end 306 of the first section 304*a* and is oriented about the same vertical axis as the second section 304*b*. The fourth section 304*d* has been added at a right angle to the distal end 313 of the section 304*b* and extends in a direction towards the right hand edge of the substrate 302.

Figure 18:
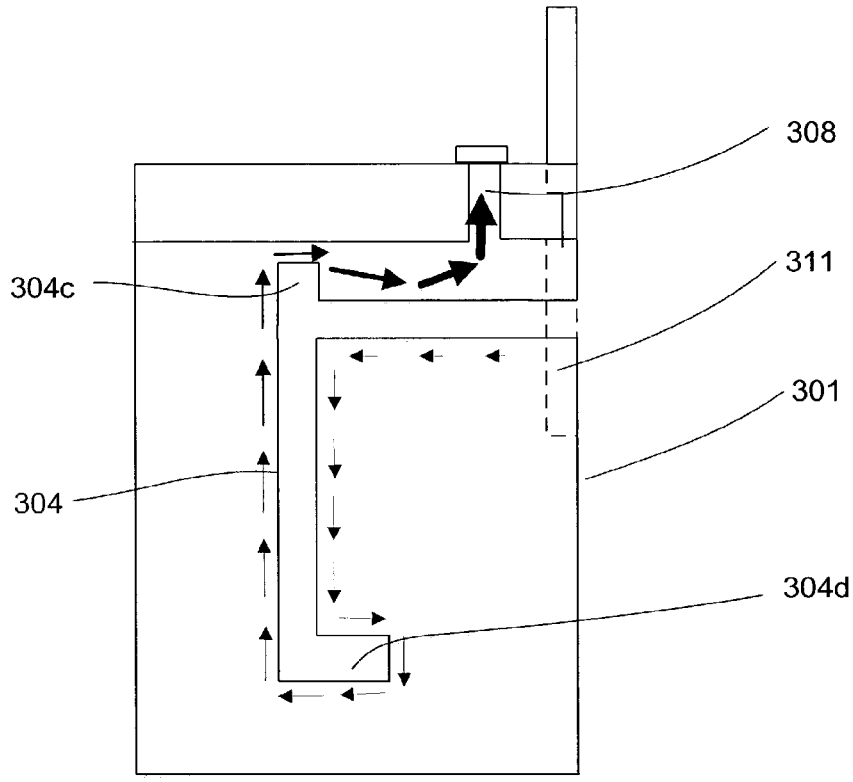
FIG. 18 is a schematic representation of the current flow around the antenna of FIG. 17 at the ¼ wavelength resonant frequency.
Figure 19:
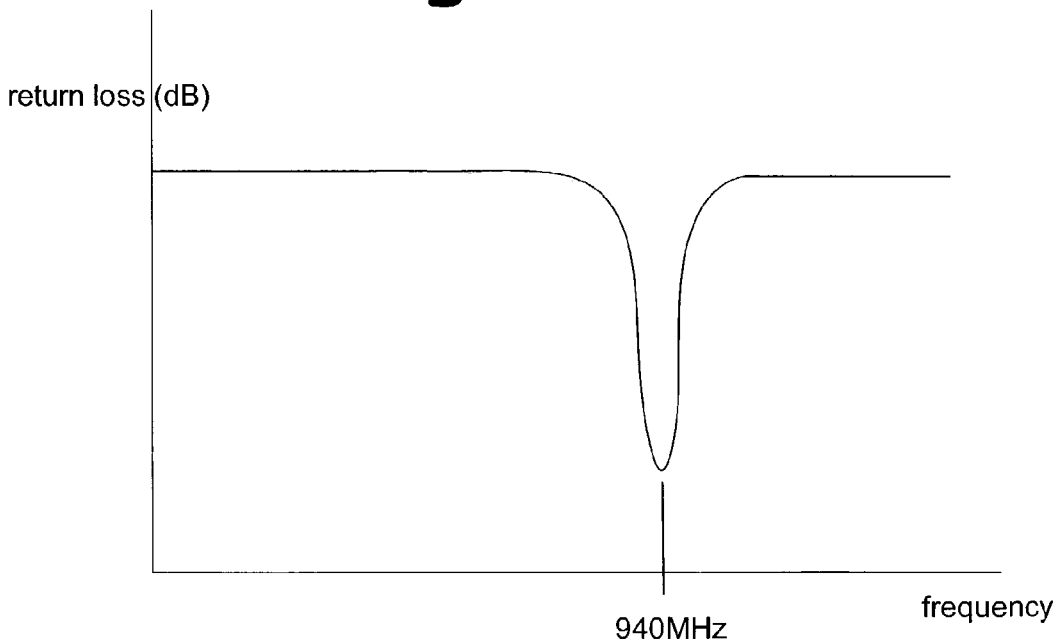
FIG. 19 is a return loss v frequency plot illustrating the ¼ wavelength resonant frequency of the antenna of FIG. 17.

The antenna 301 of FIG. 17 is illustrated with the electrical current flow around the structure at the ¼ wavelength resonant frequency in FIG. 18. It is similar to FIG. 3, with corresponding features appropriately numbered. The mean path length taken by the current around the slot 304 determines the ¼ wavelength of the antenna and in this case is 940 MHz (FIG. 19).

Comparing FIGS. 3 and 18 it can be seen that the antenna 1 has been modified by the addition of the sections 304*c* and 304*d* to the slot 4. Comparing FIGS. 4 and 19 it can be seen that changing the perimeter of the slot 304 will change the ¼ wavelength resonant frequency of the antenna 1. By increasing the current path length we have changed the resonant frequency from 980 MHz to 940 MHz. Correspondingly, it will also be appreciated that a reduction in the slot perimeter where the current density is large and therefore a reduction in the mean current path length where the current density is large would result in the ¼ wavelength resonant frequency increasing.

Figure 20:
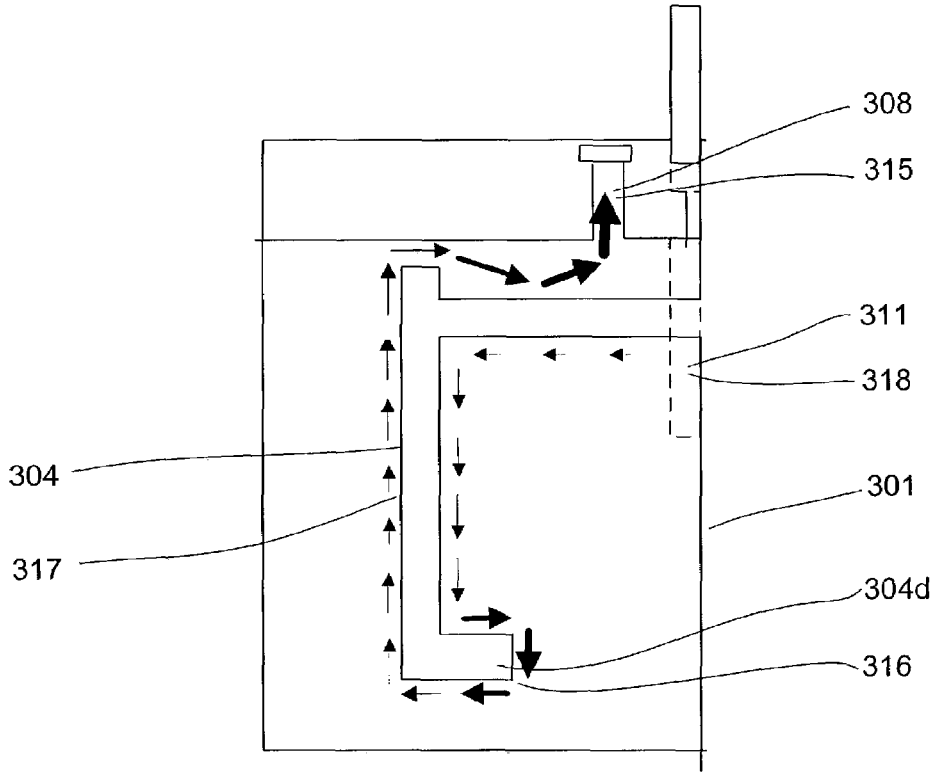
FIG. 20 is a schematic representation of current flow around the antenna of FIG. 17 at the ¾ wavelength resonant frequency.
Figure 21:
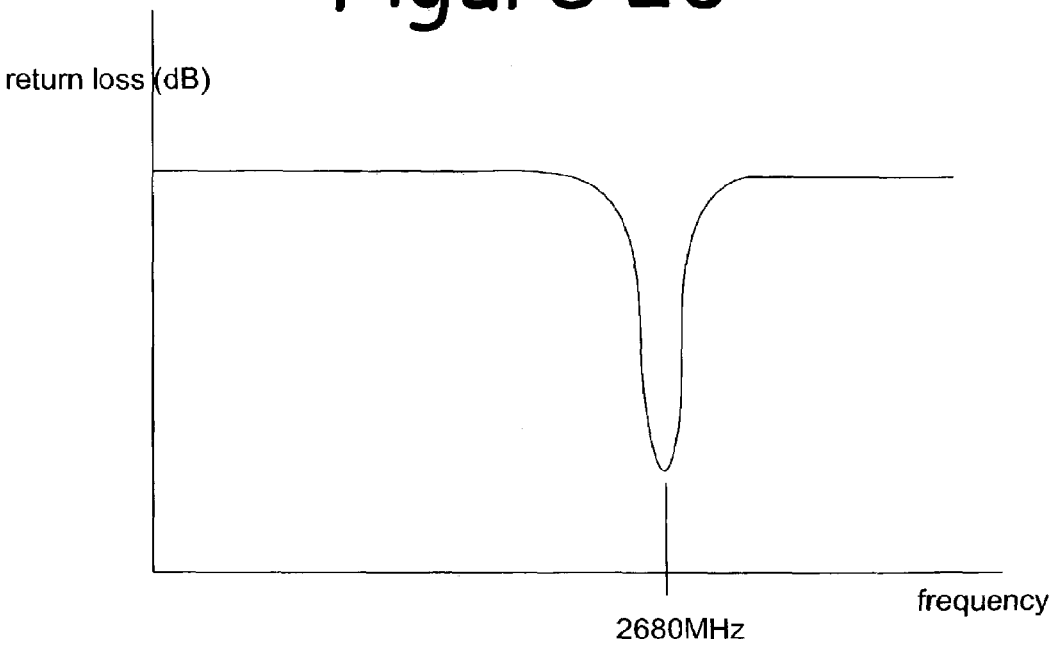
FIG. 21 is a plot illustrating the ¾ wavelength resonant frequency of the antenna of FIG. 17.

The antenna 301 of FIG. 17 is illustrated with the electrical current flow around the structure at the ¾ wavelength resonant frequency in FIG. 20. It is similar to FIG. 5, with corresponding features appropriately numbered. The mean path length taken by the current around the slot 304 determines the ¾ wavelength of the antenna and in this case is 2680 MHz (FIG. 21).

Comparing FIGS. 5 and 20 it can be seen that the antenna 1 has been modified by the addition of the sections 304*c* and 304*d* to the slot 4. Comparing FIGS. 6 and 21 it can be seen that changing the perimeter of the slot 304 and thereby changing the mean current path length will change the ¾ wavelength resonant frequency of the antenna 301. By increasing the current path length we have changed the resonant frequency from 2800 MHz to 2680 MHz. Correspondingly, it will also be appreciated that a reduction in the slot perimeter where the current density is large and therefore a reduction in the mean current path length where the current density is large would result in the ¾ wavelength resonant frequency increasing.

In summary, it will be appreciated that the addition of section 304*c* to the antenna 1 has a substantial effect on the change in ¼ wavelength resonant frequency of the antenna 1, whereas the addition of section 304*c* to the antenna 1 has a minimal effect on the change in ¾ wavelength resonant frequency of the antenna 1. Furthermore, it will also be appreciated that the addition of section 304*d* to the antenna 1 has a substantial effect on the change in ¾ wavelength resonant frequency of the antenna 1, whereas the addition of the section 304*d* to the antenna 1 has a minimal effect on the change in ¼ wavelength resonant frequency of the antenna 1. It will be appreciated that the addition of sections 304*c* or 304*d* has the effect of independently controlling the ¼ wavelength or ¾ wavelength resonant frequency respectively while the other ¾ wavelength or ¼ wavelength resonant frequency respectively is substantially fixed. It will also be appreciated that the rate of change of ¼ and ¾ wavelength resonant frequency is determined by the extent to which the geometry (overall size/shape, slot size/shape/position) of the slot 4 is altered and also where the geometry is altered with respect to the ¼ and ¾ wavelength maximum current densities around the slot 4.

Figure 17A:
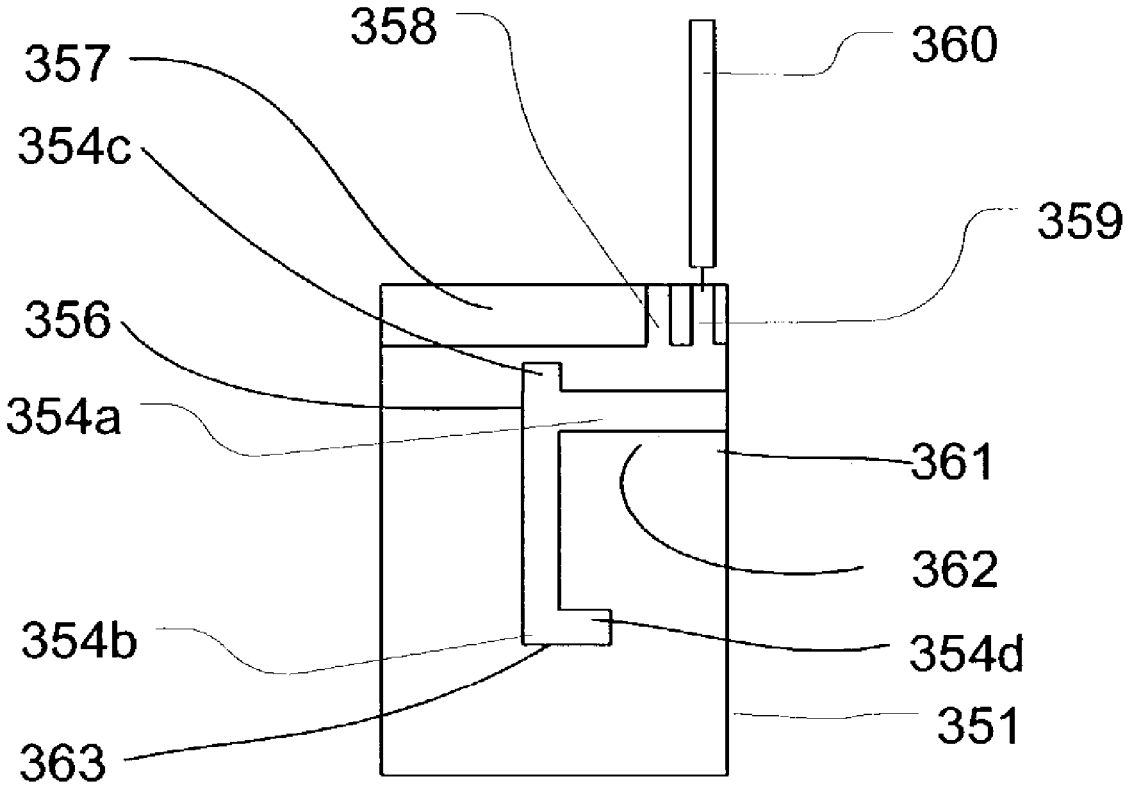
FIG. 17*a* is a drawing of the third embodiment of the antenna with a direct feed arrangement.

The embodiments described in FIGS. 7, 12 and 17 illustrate the use of an indirect feed structure, 109, 110, 209, 210 and 309, 310 respectively. A direct feed arrangement (FIG. 17*a*) could be used in preference to an indirect feed arrangement. The use of either feed structure does not change the functionality of the described invention.

Antenna 351 (FIG. 17*a*) is the same as antenna 301 (FIG. 17) except that the indirect feed structure 309, 310 has been replaced by a direct feed structure 359, 360. The features 301–308 and 311–314 of FIG. 17 are corresponding numbered 351–358 and 361–364 in FIG. 17*a*. The direct feed arrangement comprises a conductive branch 359 which is adjacent to and to the right hand side of the grounded branch 358. The conductive branch has similar dimensions to the branch 358 and is electrically connected to the surface 355. In an alternative arrangement (not shown) the position of the grounded branch 358 and the conductive branch 359 may be swapped or their positions relative to one another may be adjusted. A co-axial cable 360 is connected to the conductive strip 359 at one end and the other of the co-axial cable 360 is connected to radio circuitry (not shown).

The present invention is not restricted to the slot forms 104, 204 and 304 shown in FIGS. 7, 12 and 17 respectively. FIGS. 22–26 illustrate alternative slot forms 404–804. Each of the antennas 401–801 illustrated in FIGS. 22–26 has a short circuited branch (not shown) along the top edge of the surface 405, 505, 605, 705 and 805 respectively and an indirect feed (not shown) similar to that illustrated by 9, 10 in FIG. 2 towards the right hand edge of the surface.

Figure 22:
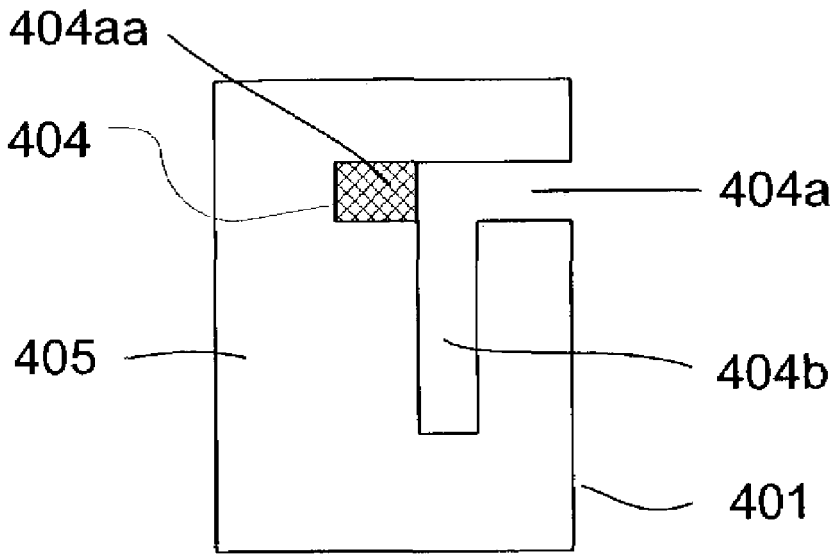
FIGS. 22 to 26 illustrate alternative slot forms of the slotted PIFA antenna according to the present invention.

Slot 404 is a T-shaped slot comprising slotted sections 404*a* and 404*b*. It has an open-ended cross piece 404*a* extending horizontally across the surface 405 of the substrate 402, (FIG. 22). A second slot 404*b* extends vertically downwards from a position midway along the slot 404*a*.

Figure 23:
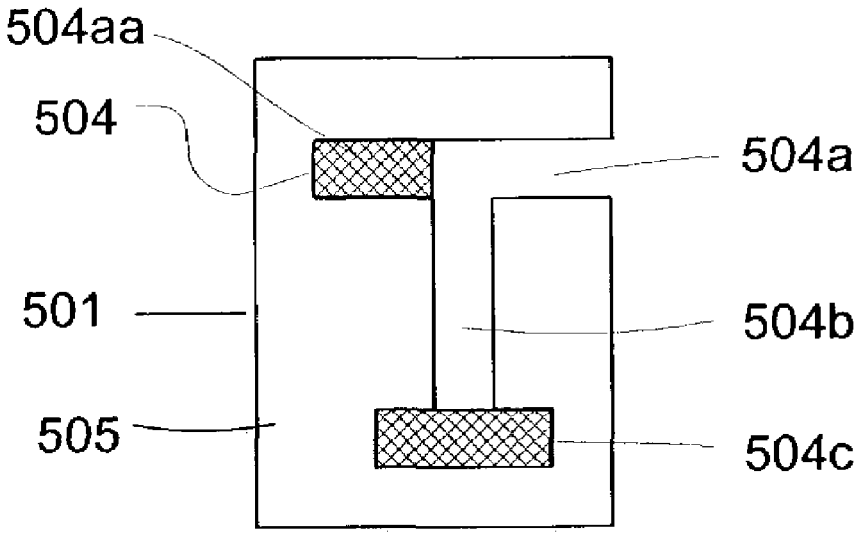

Slot 504 is an I-shaped slot comprising slotted sections 504*a*, 504*b* and 504*c*. It has an open-ended cross-piece 504*a* extending horizontally across the surface 505 of the substrate 502 (FIG. 23). A second slot 504*b* extends vertically downwards from a position midway along the slot 504*a*. A third slot 504*c* lies parallel to slot 504*a* and is connected midway along its length to slot 504*b*. Slot 504*c* is shorter in length than slot 504*a*.

Figure 24:
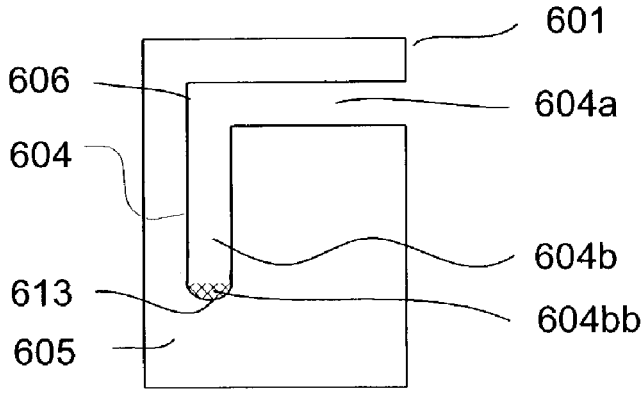

Slot 604 is a substantially L-shaped slot comprising slotted sections 604*a* and 604*b*. Slot 604 has an open-ended slot 604*a* extending horizontally across the surface 605 of the substrate 602 to a distal end 606 (FIG. 24). A second slot 604*b* extends downwards at a right angle from the distal end 606 of the slot 604*a* to a distal end 613. The slot 604*b* is substantially rectangular except at the distal end 613 where the perimeter is semi-circular.

Figure 25:
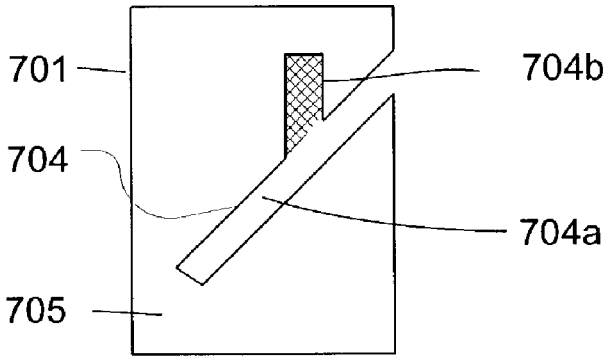

Slot 704 is a substantially y-shaped slot comprising slotted sections 704*a* and 704*b*. The open-ended slot 704*a* extends diagonally from the upper right hand edge of the surface 705 towards the lower left hand edge of the surface 705 (FIG. 25). A second slot 704*b* extends vertically upwards from a position approximately midway along the slot 704*a*

Figure 26:
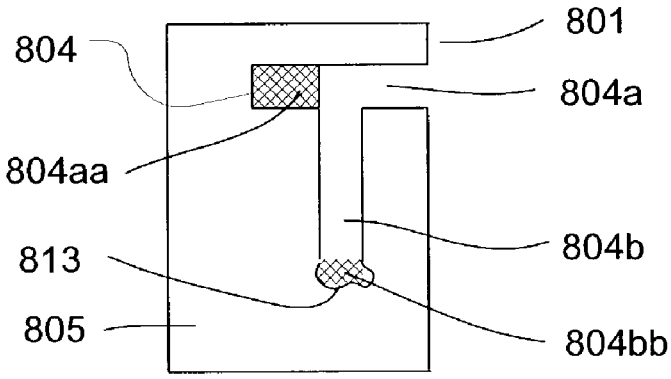

Slot 804 is a substantially T-shaped slot comprising slotted sections 804*a* and 804*b*. It has an open-ended cross-piece 804*a* extending horizontally across the surface 805 of the substrate 802, (FIG. 26). A second slot 804*b* extends downwards from a position midway along the slot 804*a* and at a right angle thereto. The second slot 804*b* is terminated at the distal end 813 with a non-uniform width caused by the distal end of the slot 804*b* being wavy.

Slot 404 (FIG. 22) illustrates a means of adjusting the ¼ wavelength resonant frequency of the antenna 401 by the addition of section 404*aa* (highlighted by the cross hatched section) when compared to the antenna 1 of FIG. 2. Slot 704 (FIG. 25) illustrates a means of adjusting the ¼ wavelength resonant frequency of the antenna 701 by the addition of section 704*b* (highlighted by the cross hatched section) when compared to a prior art slotted PIFA antenna (not shown).

The slots 504*aa* and 504*c* of FIG. 23 and slots 804*aa* and 804*bb* (highlighted by the cross hatched sections) of FIG. 26 illustrate alternative means of adjusting the ¼ wavelength and ¾ wavelength resonant frequencies respectively when compared to the antenna 1 of FIG. 2.

Slot 604*bb* (highlighted by the cross hatched section) shown in FIG. 24 illustrates a means of adjusting the ¾ wavelength resonant frequency when compared to the antenna 1 of FIG. 2.

In an alternative arrangement, re-locating the short circuit branch 8 to alternative positions on the surfaces 405, 505, 605, 705 and 805 would result in the slotted forms shown in antennas 401, 501, 601, 701 and 801 having different effects on the ¼ and ¾ wavelength resonant frequencies when compared to the antenna 1 of FIG. 2. For example, if the short circuited branch 8 as shown in FIG. 2 were moved to a position mid way down the right hand edge of the surface 705 of FIG. 25 (not shown) then the addition of the slot 704*b* would have a minimal effect on the ¼ wavelength resonant frequency but would alter the ¾ wavelength resonant frequency.

The present invention provides a means of adjusting the frequency ratio between the ¼ and ¾ wavelength resonant frequencies while maintaining independent control of the ¼ wavelength and ¾ wavelength resonant frequencies. In an application where more than two resonant frequencies are required, for example in a multi-band mobile handset, the use of two quarter wavelength resonant slotted PIFA planar elements according to the present invention would give up to four resonant frequencies at the ¼ and ¾ wavelength resonant frequencies. A further implementation of the present invention illustrating a multi-band antenna with up to four resonant frequencies will now be described by way of example.

Figure 27:
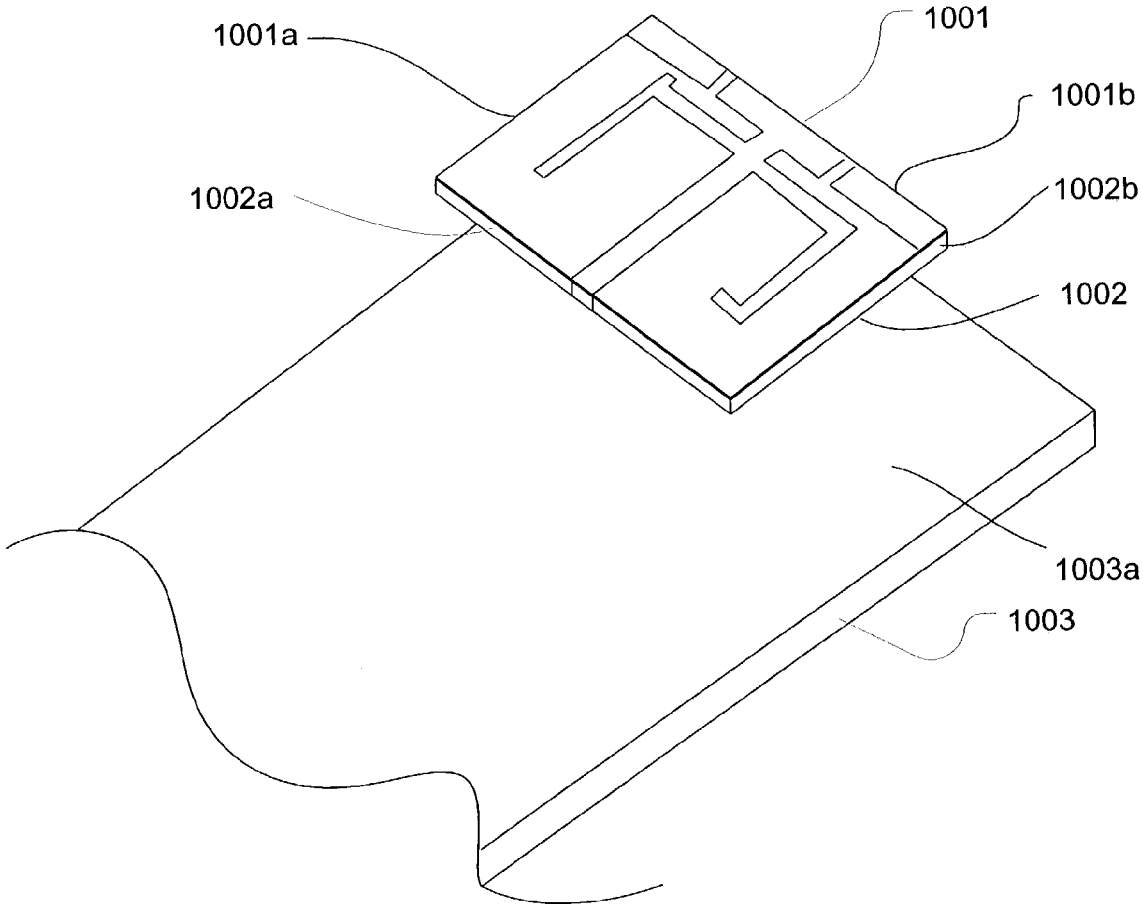
FIG. 27 is a perspective view of a multi-band antenna comprising two slotted PIFA antennas according to the present invention.

The antenna 1001 of FIG. 27 comprises two slotted PIFA antennas 1001*a*, 1001*b* disposed on a substrate 1002 mounted (mounting not shown) to a PCB 1003 of a radio communication device. The antenna/substrate 1001/1002 are generally rectangular in shape and lie above and parallel to the major face 1003*a* of the larger rectangular main PCB 1003.

Figure 28:
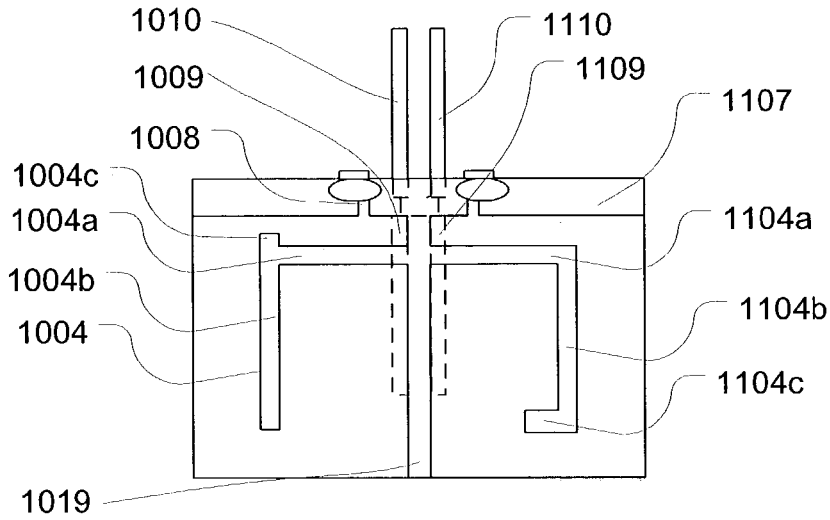
FIG. 28 is a plan view of the antenna illustrated in FIG. 27.

The first slotted PIFA antenna 1001*a* is the same as the antenna 101 of FIG. 7 and the antenna reference numbers 103–113 have corresponding reference numbers 1003–1013. The second slotted PIFA antenna 1001*b* is the same as the mirror image of the antenna 201 in FIG. 12 about a vertical axis. The antenna reference numbers 203–213 have corresponding reference numbers 1103–1113. The substrates 1002*a* and 1002*b* of the antennas 1001*a* and 1001*b* respectively are connected via a non-conductive strip 1019 (FIGS. 27 and 28) to form a single unitary substrate 1002. The open ends of the slots 1004 and 1104 open into the non-conductive strip 1019 and face one another. The antennas feed circuits 1009, 1010 and 1109, 1110 are indicated with dashed lines (FIG. 28) and may be combined using matching circuitry (not shown) to provide impedence matching between the radio circuitry and the antennas 1001*a* and 1001*b*. Alternatively it may be advantageous for the feeds to be kept separate and fed directly to suitable radio circuitry, e.g. a switch (not shown).

It will be appreciated that in a further embodiment the substrates 1002*a* and 1002*b* need not be joined by the non-conductive strip 1019 so that the antennas 1001*a* and 1001*b* exist as separate structures (not shown). In another embodiment it will be appreciated that the open ends of the slot need not face one another but may be offset from one another (not shown).

Figure 29:
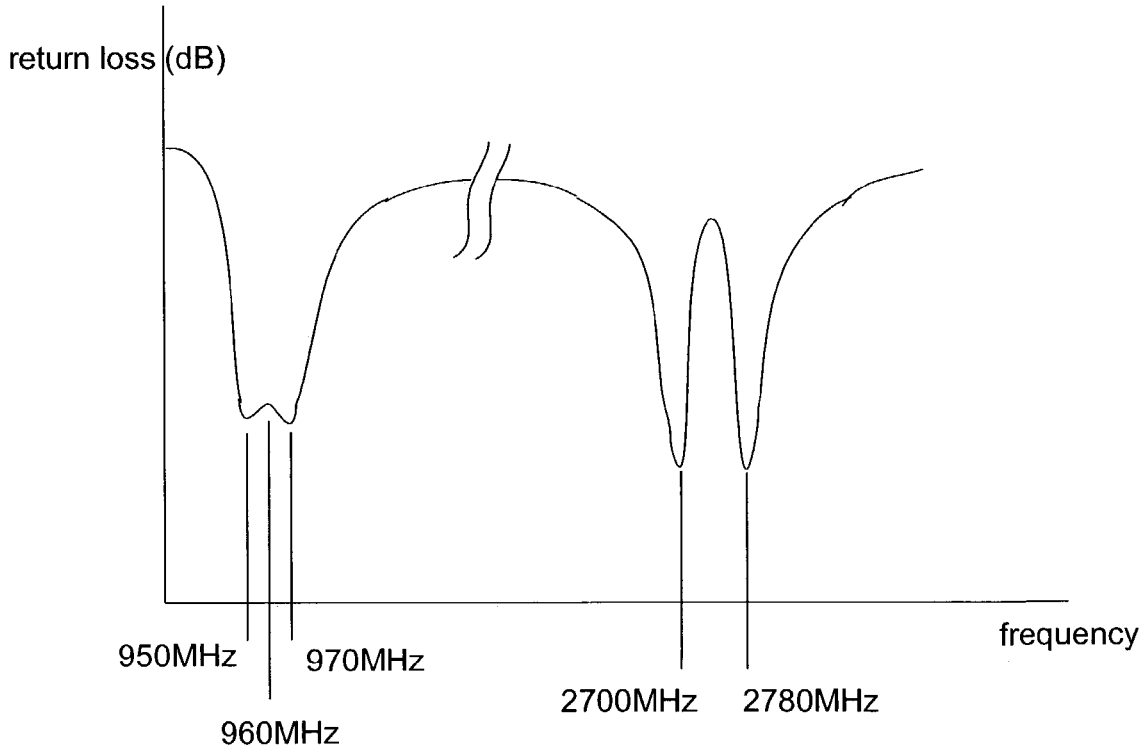
FIG. 29 is a return loss v frequency plot illustrating the ¼ wavelength and the ¾ wavelength resonant frequencies of the antenna illustrated in FIG. 27.

The antenna 1001 has ¼ wavelength resonant frequencies at 950 MHz (1001*a*) and 970 MHz (1001*b*) and ¾ wavelength resonant frequencies at 2700 MHz (1001*b*) and 2780 MHz (1001*a*), as shown in FIG. 29. The ¼ wavelength resonant frequencies of antennas 1001*a* and 1001*b* are close enough so that they overlap to form a single wider bandwidth resonant frequency, centred at 960 MHz (FIG. 29). The antenna 1001 will therefore have three distinct resonant frequencies. It will be appreciated that altering the geometry of the slots 1004 and 1104 can result in the antenna 1001 having both the ¼ wavelength and the ¾ wavelength resonant frequencies overlapping to form two wider bandwidth resonant frequencies (not shown) (in the case where the geometries of 1001*a* and 1001*b* are substantially similar). It will also be appreciated that altering the geometry of the slots 1004 and 1104 can result in the antenna 1001 having no overlapping resonant frequencies and therefore having four distinct resonant frequencies (not shown) (in the case where the geometries of 1001*a* and 1001*b* are substantially different).

Figure 30:
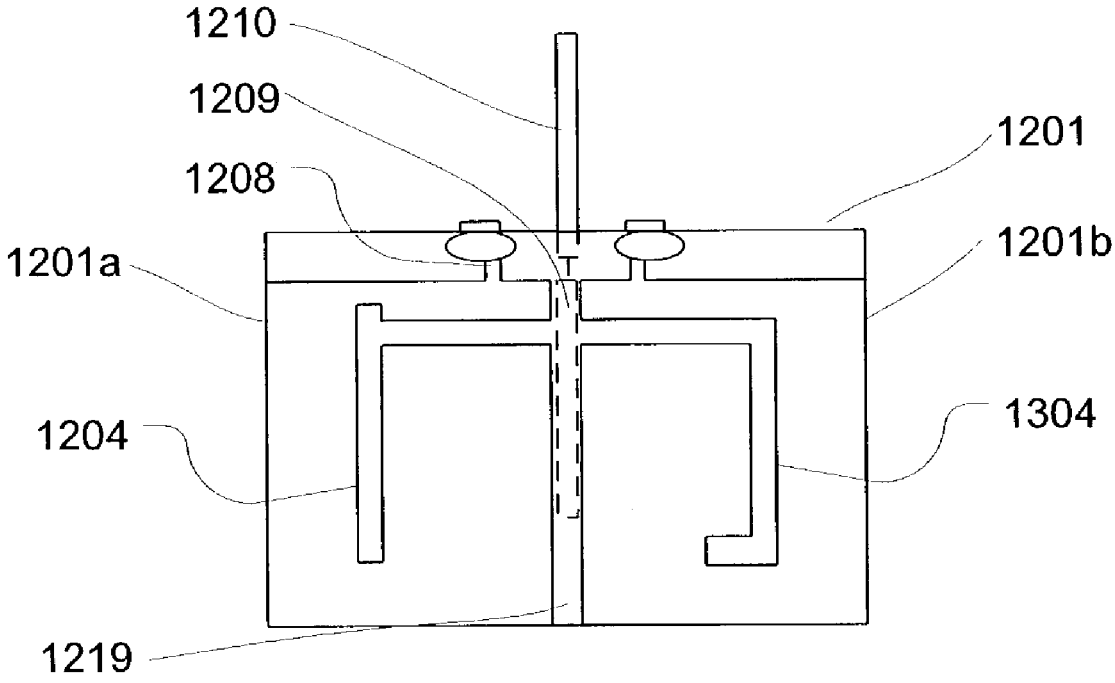
FIG. 30 is a plan view of the antenna illustrated in FIG. 27 comprising a single feed structure.

In a further embodiment an antenna 1201, which is the same as the antenna 1001 of FIG. 27 except that the feed structures 1009, 1010 and 1109, 1110 have been removed and replaced by a single feed structure 1209, 1210. References 1001–1019 and 1102–1119 have corresponding references 1201–1219 and 1302–1319. The antenna 1201 has a single feed 1209,1210 positioned midway between the antennas 1201*a* and 1201*b* and lying beneath the non-conductive strip 1219 (FIG. 30). In each of the cases shown, the open-ended slot geometry forms a polygon determined so as the sum of the interior angles excluding the open end is not 540 degrees.

It will be appreciated that many modifications may be made to the preferred embodiment described above. For instance, the antenna could be made symmetrical to give a reduced bandwidth but better matching characteristics. In addition, it will be appreciated that one or more of the various embodiments may be combined.

What is claimed is:

1. A method of independently modifying the ¼ and/or the ¾ wavelength resonant frequency in an open-ended slotted PIFA antenna, an open-ended slotted PIFA antenna comprising an antenna ground associated with the antenna short-circuit end, and an open-ended slot having an open-end associated with the antenna open-circuit end, and wherein the antenna ground and the slot are mutually arranged to provide operational variations in the current density between the open and short circuit ends of the antenna and around the perimeter of the slot, and to provide an operational mean current path length between the open and short circuit ends of the antenna and around the perimeter of the open-ended slot, the mean current path length determining the ¼ and ¾ wavelength resonant frequencies for the open-ended slotted PIFA antenna, the method comprising determining operational variations in current density around the perimeter of a pre-modified open-ended slotted PIFA antenna and modifying the mean current path length around the perimeter of the pre-modified open-ended slot in regions of comparatively high current density.

2. The method according to claim 1, wherein the method is arranged to modify the mean current path length to provide a post-modified slotted PIFA antenna with an increased ¼ wavelength resonant frequency compared to the pre-modified slotted PIFA antenna.

3. The method according to claim 1, wherein the method is arranged to modify the mean current path length to provide a post-modified slotted PIFA antenna with a decreased ¼ wavelength resonant frequency compared to the pre-modified slotted PIFA antenna.

4. The method according to claim 1, wherein the method is arranged to modify the mean current path length to provide a post-modified slotted PIFA antenna with an increased ¾ wavelength resonant frequency compared to the pre-modified slotted PIFA antenna.

5. The method according to claim 1, wherein the method is arranged to modify the mean current path length to provide a post-modified slotted PIFA antenna with a decreased ¾ wavelength resonant frequency compared to the pre-modified slotted PIFA antenna.

6. The method according to claim 1, wherein the method comprises modifying the mean current path length in regions of maximum current density.

7. The method according to claim 1, wherein the method comprises increasing the mean current path length in regions of maximum current density.

8. The method according to claim 1, wherein the method comprises decreasing the mean current path length in regions of maximum current density.

9. The method according to claim 1, wherein the method comprises modifying the mean current path length by modifying the slot perimeter in the regions of comparatively high current density.

10. The method according to claim 1, wherein the method comprises modifying the mean current path length by increasing the slot perimeter in the regions of comparatively high current density.

11. The method according to claim 1, wherein the method comprises modifying the mean current path length by decreasing the slot perimeter in the regions of comparatively high current density.

12. The method according to claim 1, wherein the method comprises modifying the mean current path length by providing one or more additional slot branches in high current density regions.

13. The method according to claim 1, wherein the method comprises modifying the mean current path length by providing one or more additional notches within the slot in high current density regions.

14. A method of designing an open-ended slotted PIFA antenna according to the method of claim 1.

15. An open-ended slotted PIFA antenna produced by the method of claim 1.

16. A open-ended slotted PIFA antenna produced by the method of claim 1, wherein the post-modified slotted PIFA antenna has a ¼ and ¾ wavelength resonant frequencies having a ratio of 1: not 3.

17. A open-ended slotted PIFA antenna produced by the method of claim 1, wherein the coupling effects are low compared to geometrical effects in providing a ¼ and ¾ wavelength resonant frequencies having a ratio of 1: not 3.

18. An open-ended slotted PIFA antenna having a ¼ and ¾ wavelength resonant frequency, the open-ended slotted PIFA antenna comprising an antenna ground associated with the antenna short-circuit end, and an open-ended slot having an open-end associated with the antenna open-circuit end, and wherein the antenna ground and the slot are mutually arranged to provide operational variations in the current density between the open and short circuit ends of the antenna and around the perimeter of the slot and to provide an operational mean current path length between the open and short circuit ends of the antenna and around the perimeter of the open-ended slot, the mean current path length determining the ¼ and ¾ wavelength resonant frequencies for the open-ended slotted PIFA antenna, and wherein the geometry of the antenna is such that the ¼ and ¾ wavelength resonant frequencies of the antenna are in a ratio 1: not 3, this ratio not being substantially attributable to coupling effects.

19. The antenna according to claim 18, wherein the geometry of the antenna comprises the geometry of the slot.

20. The antenna according to claim 18, wherein the geometry of the antenna is the geometrical shape of the slot and the relative position of the antenna short/open circuit ends to the geometrical shape of the slot.

21. A multi-band antenna according to claim 18.

* * * * *